US006586062B1

(12) United States Patent
Deschamps

(10) Patent No.: US 6,586,062 B1
(45) Date of Patent: Jul. 1, 2003

(54) DEVICE FOR ROLLING OUT ON THE FLOOR A ROLLED STORED TEMPORARY SURFACE COVERING

(75) Inventor: Georges-Paul Deschamps, Angouleme (FR)

(73) Assignee: Etablissements A. Deschamps & Fils, La Couronne (FR)

( * ) Notice: Subject to any disclaimer, the term of this patent is extended or adjusted under 35 U.S.C. 154(b) by 0 days.

(21) Appl. No.: 09/646,606

(22) PCT Filed: Mar. 19, 1999

(86) PCT No.: PCT/FR99/00646

§ 371 (c)(1),
(2), (4) Date: Nov. 13, 2000

(87) PCT Pub. No.: WO99/49135

PCT Pub. Date: Sep. 30, 1999

(30) Foreign Application Priority Data

Mar. 20, 1998 (FR) ..... 98 03702

(51) Int. Cl.[7] ..... B65H 16/00

(52) U.S. Cl. ..... 428/35.2; 428/188; 428/906; 242/159; 242/550

(58) Field of Search ..... 428/35.2, 36.9, 428/188, 906; 242/159, 550

(56) References Cited

U.S. PATENT DOCUMENTS

| | | | | |
|---|---|---|---|---|
| 3,999,879 A | | 12/1976 | Stachiw et al. | |
| 4,106,149 A | * | 8/1978 | Larsson | 14/27 |
| 4,541,517 A | * | 9/1985 | O'Reilly | 193/4 |

FOREIGN PATENT DOCUMENTS

| | | |
|---|---|---|
| DE | 2429987 A1 | 1/1976 |
| DE | 4314096 A1 | 11/1994 |

* cited by examiner

*Primary Examiner*—Alexander S. Thomas
(74) *Attorney, Agent, or Firm*—Young & Thompson

(57) ABSTRACT

The object of the invention is a device for deploying on the ground a temporary surface covering (1) stored rolled, characterized by the combination, on the one hand, of the temporary surface covering (1) and, on the other hand, by at least one flexible tube (2) pressed against the internal surface of said covering (1) over substantially all its length and in conjunction with the covering, said flexible tube (2) being adapted to be connected, at the free end of the rolled-up assembly, to a source of fluid under pressure (5) for its inflation.

11 Claims, 1 Drawing Sheet

FIG.1
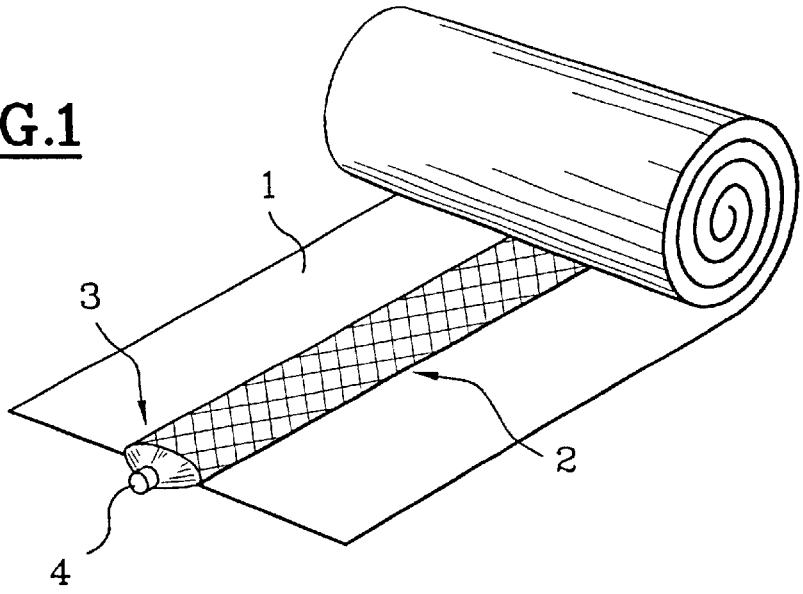
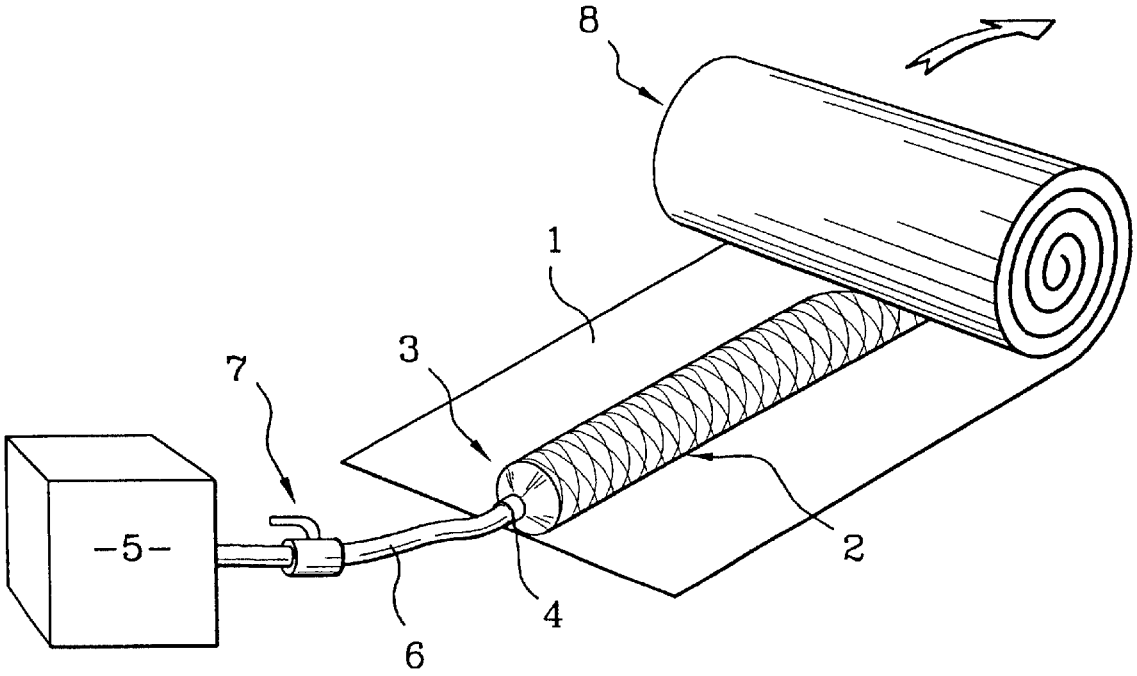
FIG.2

DEVICE FOR ROLLING OUT ON THE FLOOR A ROLLED STORED TEMPORARY SURFACE COVERING

BACKGROUND OF THE INVENTION

The present invention relates to the emplacement on the ground of a temporary surface covering stored rolled either on itself in the manner of a carpet or on a winding spool.

The invention is applicable in the first instance to the type of temporary covering for the movement of vehicles on sandy, muddy or marshy ground, described in French patent 2 718 158 but also to any other type of temporary covering for the same purpose but of different construction such as a metal mesh structure of the type described in British patent 2 212 177, to the extent that such a covering can be stored by being rolled up on itself or on any support spool.

The object of the present invention is to provide a simple, effective and less costly means permitting the deployment on the ground by unrolling, of a covering formed by a rectangular strip of several meters width and several tens of meters length, stored in the rolled condition.

Such coverings generally require heavy, costly means that are difficult to maneuver, for their deployment, for example automotor systems or tractors with an orientable tower carrying the covering in the rolled or wound condition, such a system being shown for example in French patent 2 021 199 or else in French patent 2 492 427.

SUMMARY OF THE INVENTION

Instead of and in place of these means, the invention provides a device characterized by the combination, on the one hand, of the temporary surface covering and, on the other hand, of at least one flexible tube secured against the internal surface of said covering over substantially all its length and rolled conjointly with the covering, said flexible tube being adapted to be connected, at the free end of the rolled up assembly, to a source of fluid under pressure for its inflation.

At the site of deployment of such a rolled-up assembly, it suffices to lay said assembly on the ground, to connect said free end of the flexible tube to a source of fluid under pressure, for example air, and to inflate the tube, which expands progressively axially and pushes before it the rolled-up assembly which unrolls itself from one end to the other.

BRIEF DESCRIPTION OF THE DRAWING

Other characteristic and advantages will become apparent from the description which follows, of an embodiment of the invention, which description is given by way of example and with respect to the accompanying drawing, in which:

FIG. 1 is a schematic perspective view of a device according to the invention, the flexible deployment tube being flattened, and FIG. 2 shows the device of FIG. 1 after connection of the flexible tube to a source of air under pressure.

DESCRIPTION OF THE PREFERRED EMBODIMENTS

In FIG. 1, there is shown schematically at 1 a temporary surface covering, for example of the type described in French patent No. 2 718 158 filed in the name of the applicant, and constituted by a woven strip that is contoured, for example 4.2 m wide and 25 m long, rolled on itself for its storage.

According to the invention, for unrolling the strip 1, there is disposed substantially along its longitudinal axis and in the middle region a flattened flexible tube 2, substantially the same length as the strip 1, and if desired secured to this latter.

After superposing the elements 1 and 2 over all their length, the assembly is rolled up on itself as shown in FIG. 1, the tube 2 being on the internal surface of the strip 1.

The tube 2 is for example a sleeve of commercial plastic material, such as a flexible heating sleeve, 500 mm in diameter. In the flattened condition, this sleeve 2, whose wall is relatively thin, takes up less space and does not interfere with the unrolling of the strip 1 whose weight and size it does not substantially increase, the increase in thickness in the middle region of the rolled-up assembly being negligible.

The end of the tube 2 is located at the center of the roll and is either closed or open to permit a certain escape of air, or completely open, as at the other end 3, the so-called open end, the only one accessible when the assembly is rolled up.

This free end 3 is provided with a connection 4, for securement (FIG. 2) to a source of compressed air 5, or any other fluid, via a tube 6 provided with a control valve 7.

It is clear that when air under pressure is sent into the tube 2, the expansion of this latter will push the unrolled portion 8 of the assembly 1–2, in the direction of the arrow in FIG. 2, and will progressively unroll it over all its length, pressing the strip 1 against the ground.

The tube 2 does not need to be secured to the strip 1 to produce its unrolling effect, such that after total unrolling of the strip 1, the tube 2 can be recovered for reuse.

At the time of recovery after use of the strip 1, the tube 2 can be simply repositioned along the medial axis of the strip 1, the assembly being then rolled up manually or mechanically by suitable means. By way of example, with a strip 1 of the type indicated above, a pressure of 0.2 bar is sufficient to unroll it on substantially level ground.

For unrolling it on inclined ground, the overpressure necessary is modest, because, for example, for a slope of 670 mm in 3 meters, it suffices to apply a pressure of 0.5 bar.

The air, or any other fluid, can be supplied at the desired pressure by any suitable means. It can even be envisaged to use the pressure of the exhaust gases of the transport vehicle at the site of the various covering elements to be deployed.

The assembly 1–2 can be deployed on ground covered with water, for example for crossing a water course or a body of water. In this case, so that the assembly 1–2 will be deployed on the bottom of the body of water, it is water under pressure which is sent into the tube to cause the assembly to flow into the water.

Instead of a single tube 1, there can be provided several tubes, two for example, disposed in parallel for example adjacent the edges of the strip 1, the tubes being inflated simultaneously. With such an arrangement, it is possible to inflate one tube more than the other so as to deflect the deployment of the covering 1, which is to say its orientation, the covering thereby veering slightly, from one side to the other, for example so as better to match the configuration of the ground.

The invention is applicable to any structure of deployable strip 1, even metallic, adapted to be unrolled from itself or from a central spool or tube.

The invention permits deploying safely a temporary covering for the movement of vehicles or of personnel over a mined or dangerous terrain, the covering can moreover be designed to essentially detect and/or destroy mines, by providing it for example for this purpose with means suitable for the detection and/or destruction of mines.

What is claim is:

1. A device for deploying on the ground a temporary surface covering stored rolled, the device comprising:

only one flexible tube disposed against one of the surfaces of the covering over substantially its length, in a manner substantially perpendicular to an axis of rolling/unrolling, and rolled up conjointly with the covering, said flexible tube being adapted to be connected, at a free end of the rolled-up assembly, to a source of fluid under pressure for its inflation.

2. The device according to claim 1, wherein said tube is a sleeve with a thin wall not secured to the covering.

3. The device according to claim 1, wherein the free end of the tube is provided with a connector for connection to a source of air under pressure.

4. The device according to claim 1, wherein an end of the tube internal to the unrolled assembly is at least partially opened.

5. A device for deploying on the ground a temporary surface covering stored rolled, the device comprising:

at least one flexible tube disposed against one of the surfaces of the covering over substantially its length, in a manner substantially perpendicular to the axis of rolling/unrolling, and rolled up conjointly with the covering, said flexible tube being adapted to be connected, at a free end of the rolled-up assembly, to a source of fluid under pressure for its inflation, an end of the tube internal to the unrolled assembly being at least partially opened.

6. The device according to claim 5, wherein the free end of the tube is provided with a connector for connection to a source of air under pressure.

7. A device for deploying on the ground a temporary surface covering stored rolled, the device comprising:

at least one flexible tube disposed against one of the surfaces of the covering over substantially its length, in a manner substantially perpendicular to the axis of rolling/unrolling, and rolled up conjointly with the covering, said flexible tube being constituted by a sleeve with a thin wall not secured to said covering, said flexible tube being further adapted to be connected, at a free end of the rolled-up assembly, to a source of fluid under pressure for its inflation.

8. The device according to claim 7, wherein the free end of the tube is provided with a connector for connection to a source of air under pressure.

9. The device according to claim 7, wherein an end of the tube internal to the unrolled assembly is at least partially opened.

10. A process for the deployment of a temporary surface covering on a ground covered with water, comprising the following steps of:

first disposing at least one flexible tube against an upper surface of the temporary surface covering substantially perpendicular to an axis of rolling/unrolling, over substantially all its length, then rolling up conjointly said covering and said tube, and for deployment, connecting the flexible tube to a source of water under pressure for its inflation so as automatically to unroll the temporary surface covering and to cause said covering to flow onto the ground covered with water.

11. A process for the deployment on the ground of a temporary surface covering, the device having two flexible tubes disposed against one of the surfaces of the covering over substantially its length, in a manner substantially perpendicular to the axis of rolling/unrolling, and rolled up conjointly with the covering, the two flexible tubes being placed parallel to each other adjacent the edge of the covering, said process comprising the step of inflating differently said two flexible tubes so as to deflect the deployment to obtain a diversion.

* * * * *